US007240617B1

(12) United States Patent
Bonbrake et al.

(10) Patent No.: US 7,240,617 B1
(45) Date of Patent: Jul. 10, 2007

(54) WEAPON ARMING SYSTEM AND METHOD

(75) Inventors: Timothy B. Bonbrake, Tucson, AZ (US); Christopher J. Rutz, Tucson, AZ (US); Christina L. Adair, Vail, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/389,766

(22) Filed: Mar. 27, 2006

(51) Int. Cl.
*F42C 15/00* (2006.01)

(52) U.S. Cl. ..... 102/221; 102/215; 102/262

(58) Field of Classification Search ..... 102/215, 102/218, 219, 220, 262, 263, 264
See application file for complete search history.

(56) References Cited

U.S. PATENT DOCUMENTS 5,063,846 A * 11/1991 Willis et al. ..... 102/215

5,251,548 A * 10/1993 Spence ..... 102/221

* cited by examiner

*Primary Examiner*—Michelle Clement
*Assistant Examiner*—Benjamin P. Lee
(74) *Attorney, Agent, or Firm*—Renner, Otto, Boisselle & Sklar, LLP.

(57) ABSTRACT

An arming system for a weapon, such as a missile, includes a pair of logic elements that output different types of signals upon the occurrence of different pre-arming events. The different types of signals may be, for instance, signals at different frequencies. The different signals are combined in a mixer. The mixed combined signal may be processed by passing it though elements such as a band pass filter and/or a pulse-width modulator/controller. An arming switch is configured to initiate arming when a predetermined condition in the combined signal is detected, such as the presence of a frequency in the combined signal at the difference between the frequencies of the individual signals from the logic elements. By basing arming on characteristics of a mixed combined signal from two logical elements, there are no credible single-point failure modes in the arming system.

20 Claims, 1 Drawing Sheet

WEAPON ARMING SYSTEM AND METHOD

BACKGROUND OF THE INVENTION

1. Field of the Invention

This invention relates to the field of arming safety systems and methods.

2. Description of the Related Art

In arming weapons systems, it is required that two independent logic elements are utilized to control weapon arming safety, such as for a missile warhead. One of the logic elements may involve sending a signal upon the occurrence of one or more launch events. Examples of launch events include the disconnection of an umbilical connection between a missile and a launching aircraft, pull of a lanyard on the weapon, sending of an ignition signal, and pressure in the base of the missile.

The other logic element may involve sending a signal upon the occurrence of one or more flight events. Examples of such flight events include sustained flight acceleration, eject shock, a launch pulse, spinning of the missile, turning of a wind turbine on the weapon or missile, elevated pressure in a pitot-static tube, actuation of a wing/fin switch, and detection of a weapon arming maneuver (WAM).

The launch events and the flight events collectively constitute a group of logic events. In an arming system, as each successive logic event is satisfied (reaches a "true" value), the associated safety locks of the system are successively removed. Eventually the system is reduced to one remaining safety lock that prevents arming. This is a single-point failure condition, wherein a failure of the single remaining safety lock would result in undesired arming of the weapon, perhaps resulting in premature detonation.

Despite the problems that might result from premature arming or detonation of a weapon, the existence of a single-point failure mode is presently tolerated in current missile systems. The risk is reduced somewhat by attempts to minimize the amount of time in which a single-point failure would result in arming or detonation.

From the foregoing it will be appreciated that there is room for possible improvement in arming systems for missiles and other weapons.

SUMMARY OF THE INVENTION

According to an aspect of the invention, an arming system for weapons includes a pair of logic elements that output different types of signals, such as signals at different frequencies. The signals may be combined, processed, and used to determine whether to trigger an arming switch.

According to another aspect of the invention, a weapon arming system includes: a pair of logic elements actuated by separate respective arming events, wherein the logic elements selectively send different respective types of output signals in response to the occurrence of the arming events; and an arming switch that selectively outputs an arming signal based on receipt of the output signals from both of the logic elements. The output signals are combined into a single mixed signal prior to being passed to the arming switch.

According to yet another aspect of the invention, a method of arming a weapon, the method includes the steps of receiving respective output signals from a pair of logic elements actuated by separate respective arming events, wherein the logic elements selectively send different respective output signals in response to the occurrence of the arming events; electrically combining the output signals into a mixed signal; and passing the mixed signal to an arming switch that selectively outputs an arming signal based on the mixed signal.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

An arming system for a weapon, such as a missile, includes a pair of logic elements that output different types of signals upon the occurrence of different pre-arming events. The logic elements may be analog and/or digital elements. One of the logic elements may include one or more logical events relating to launching events of the weapon. The other logical element may include one or more logical events relating to flight events of the weapon. The different types of signals may be, for instance, signals at different frequencies. The different signals are combined in a mixer. The mixed combined signal may be processed by passing it though elements such as a band pass filter and/or a pulse-width modulator/controller. An arming switch is configured to initiate arming when a predetermined condition in the combined signal is detected, such as the presence of a frequency in the combined signal at the difference between the frequencies of the individual signals from the logic elements. By basing arming on characteristics of a mixed combined signal from two logical elements, there are no credible single-point failure modes in the arming system, such that failure of a single element would cause accidental or undesired arming.

Figure 1:
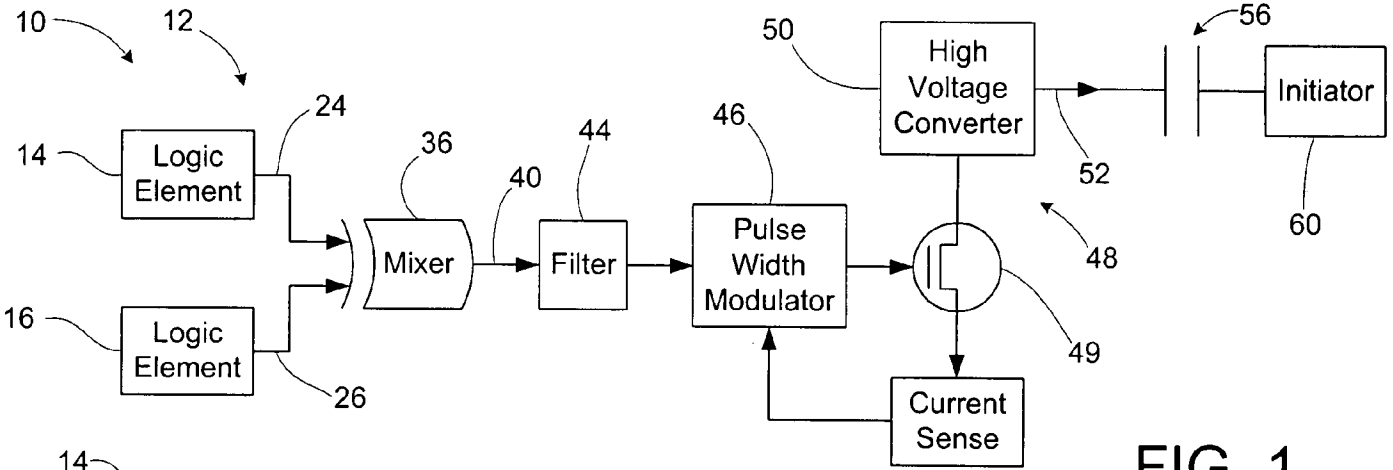
FIG. 1 is a schematic diagram of a weapon arming system in accordance with the present invention.

Referring to FIG. 1, a weapon arming system 10, such as for arming a missile, includes an arming circuit 12 that includes a pair of logical elements 14 and 16. The logical elements 14 and 16 are in essence safety locks that prevent arming or detonation of a warhead or other weapon portion until one or more corresponding events (referred to herein as "logical events") have occurred. The logical elements 14 and 16 may be analog and/or digital elements.

The logical events that trigger sending of signals by the logical elements 14 and 16 may include any of a variety of events, some of which have been mentioned already. One of the logic elements 14 and 16 may include one or more logical events relating to launching events of the weapon (events indicating or associated with the weapon being in free flight). The other of the logical elements 14 and 16 may include one or more logical events relating to flight events of the weapon (events indicating or associated with flight of the weapon).

Figure 2:
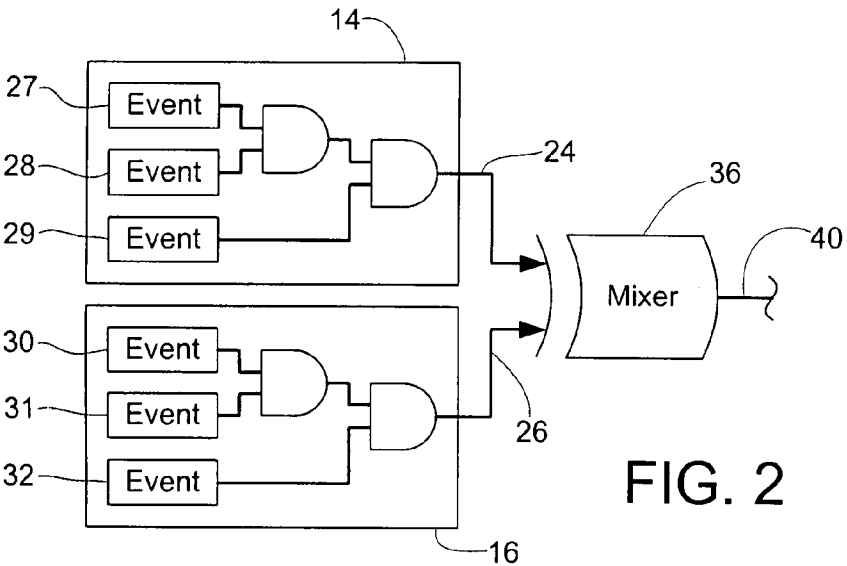
FIG. 2 is another schematic diagram, showing other aspects of the weapon arming system of FIG. 1.

With reference now in addition to FIG. 2, the logical elements 14 and 16 output respective signals 24 and 26. The first logical element 14 outputs the first output signal 24 when its logical events 27, 28, and 29 are satisfied. The logical events 27, 28, and 29 may be chained together within the first logical element 14 by any of a variety of suitable ways of logical chaining, such as by use of AND gates. Satisfaction of the logical events 27-29 may be determined by appropriate sensors, which may be used to trigger sending of a signal from a given one of the logical events 27-29, indicating that the corresponding event has occurred. The signal may be sending of a voltage to an input port of the AND gate that the logical event is coupled to. Similarly, the second logical element 16 outputs the second output signal 26 when its logical events 30, 31, and 32 are satisfied.

The output signals 24 and 26 are different types of signals. That is, the output signals 24 and 26 are differentiable from one another in terms of characteristics of the signals 24 and 26. Broadly, the signal characteristics include the constant voltage level of the signals, and characteristic temporal variations in the signal, such as frequency, voltage range of temporal variations, and signal shape. In one embodiment, the output signals 24 and 26 are alternating current (AC) square-wave signals having different frequencies. For instance, one of the signals 24 and 26 may have a frequency of 500 kHz, while the other of the signals 24 and 26 has a frequency of 375 kHz. The signals 24 and 26 may alternatively have any of a wide variety of other frequencies, with other frequency differences. Also, periodic signals used may have any of a variety of suitable shapes, such as square wave, saw tooth, or sine wave.

The signals 24 and 26 may be generated by oscillators within the logic elements 14 and 16. The oscillators perform different time-based operations, such as double integration, that produce the signals 24 and 26 with different respective frequencies.

The signals 24 and 26 are combined together in a mixer 36, to produce a combined or mixed signal 40. The mixer 36 in the illustrated embodiment is a logical Exclusive OR (XOR) gate utilized as a signal mixer, but other types of suitable mixers could alternatively be used. For example, other types of logical gates, such as an AND gate or an OR gate, could be employed as the mixer 36. It is desirable that the mixer 36 work efficiently. When the signals 24 and 26 are signals with different frequencies, the mixed signal 40 includes the sums and differences of the frequencies of the signals 24 and 26. In addition, in such a situation the mixed signal 40 also includes harmonics of the signals 24 and 26.

The mixed signal 40 is then passed through a filter 44. The filter may be a band pass filter that filters out parts of the mixed signal 40 except in a specified range of interest. For example, the filter 44 may be a band pass filter that filters out frequencies above a subfrequency that is the difference between the frequencies of the signals 24 and 26. In the case when the signals are at frequencies of 500 kHz and 375 kHz, this subfrequency is at 125 kHz, and the filter 44 in such a situation may be a band pass filter that filters out frequencies greater than or less than the 125 kHz subfrequency of interest.

It will be appreciated that the filter 44 may alternatively be configured to emphasize other frequencies. For example, the filter 44 could be configured to filter out frequencies other than the difference of the frequencies of the signals 24 and 26. However, using subfrequencies that are lower than either of the frequencies of the signals 24 and 26 may be advantageous because subfrequencies are less likely to be generated by failure modes of the logic elements 14 and 16.

By filtering out certain frequencies of the mixed signal 40, the filter 44 prevents the mixed signal 40 from passing through except when both of the signals 24 and 26 are present in the mixed signal 40. Thus only when both of the logic elements 14 and 16 have their logic events satisfied does the mixed signal 40 pass through the filter 44.

After passing through the filter 44, the mixed signal 40 passes through a pulse width modulator 46. The pulse width modulator 46 alters the mixed signal 40 to make it suitable for use by the dynamic arming switch 48. The arming switch 48 includes a switch 49 and a high voltage converter 50. The switch 49 passes the signal to the high voltage converter 50, which operates as a flyback transformer. The high voltage converter 50 generates a firing energy 52 at a high voltage, such as at about 1200 volts. This high-voltage firing energy 52 is stored on a firing capacitor 56. Once a desired amount of energy is stored on the firing capacitor 56, the energy is used to initiate ignition, such as of a pyrotechnic device or initiator 60.

The arming circuit 12 advantageously allows monitoring of the output signals 24 and 26 to determine if both of the logic elements 14 and 16 have had their respective logical events satisfied. The use of different types of signals that are combined, processed, and examined (in a manner of speaking) to determine both signals are present. By combining both of the signals 24 and 26, and processing the mixed signal 40 as discussed above, a single failure point in the arming circuit 12 is avoided. There is no credible failure of any of the elements of the arming circuit 12 that would result in the firing signal 52 being accidentally generated and sent on to the firing capacitor 56. Even if one of the logic elements 14 and 16 was to fail, it is not credible that its failure mode would involve it sending out a signal at the proper frequency such that the combined signal 40 would pass through the filter 44. If either of the signals 24 and 26 is of the incorrect frequency, the combined signal 40 would not pass through the filter 44. Also, in order to generate ignition of the fuze 60, the required mixed signal 40 must be generated for a sufficient time to store energy in the firing capacitor 56.

Figure 3:
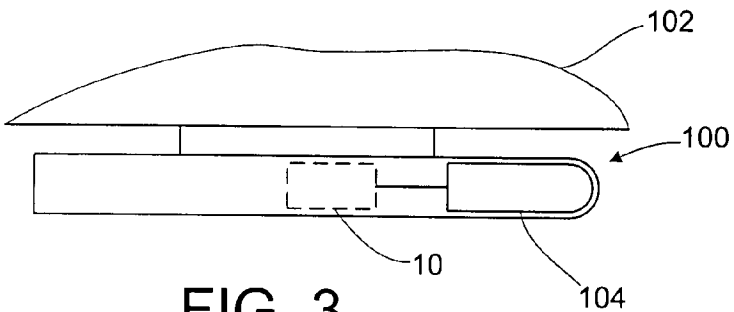
FIG. 3 is a schematic diagram showing the weapon arming system of FIGS. 1 and 2 as part of an aircraft-launched missile.

As illustrated in FIG. 3, the arming system 10 may be part of a missile 100 launched from an aircraft 102. The arming system 10 may be used as described above for arming or detonating a warhead 104 of the missile 100.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A weapon arming system comprising:

a pair of logic elements actuated by separate respective arming events, wherein the logic elements selectively send different respective types of output signals in response to the occurrence of the arming events;

a mixer that combines the output signals of the logic elements into a single mixed signal;

an arming switch that selectively outputs an arming signal based on receipt of the output signals from both of the logic elements; and a filter between the mixer and the arming switch that filters the mixed signal;

wherein the output signals are combined into the single mixed signal prior to being passed to the arming switch;

wherein the filter is a band pass filter; and wherein the output signals have different respective frequencies.

2. The weapon arming system of claim 1, wherein the band pass filter is tuned to a difference between the different frequencies of the output signals of the logic elements.

3. A weapon arming system comprising: a pair of logic elements actuated by separate respective arming events, wherein the logic elements selectively send different respective types of output signals in response to the occurrence of the arming events;

a mixer that combines the output signals of the logic elements into a single mixed signal;

an arming switch that selectively outputs an arming signal based on receipt of the output signals from both of the logic elements;

a filter between the mixer and the arming switch that filters the mixed signal; and a pulse-width modulator/controller between the filter and the arming switch;

wherein the output signals are combined into the single mixed signal prior to being passed to the arming switch; and wherein the output signals have different respective frequencies.

4. The weapon arming system of claim 3, wherein at least one of the logic elements is a digital logic element.

5. The weapon arming system of claim 3, wherein at least one of the logic elements is an analog logic element.

6. A weapon arming system comprising:

a pair of logic elements actuated by separate respective arming events, wherein the logic elements selectively send different respective types of output signals in response to the occurrence of the arming events; and an arming switch that selectively outputs an arming signal based on receipt of the output signals from both of the logic elements;

wherein the output signals are combined into a single mixed signal prior to being passed to the arming switch; and wherein the output signals have different respective frequencies.

7. The weapon arming system of claim 6, wherein the arming switch sends the arming signal based on whether the mixed signal contains a difference frequency at a difference between the different frequencies of the logic elements.

8. The weapon arming system of claim 7, wherein at least one of the logic elements is a digital logic element.

9. The weapon arming system of claim 7, wherein at least one of the logic elements is an analog logic element.

10. The weapon arming system of claim 6, further comprising a mixer that combines the output signals of the logic elements into the mixed signal.

11. The weapon arming system of claim 10, further comprising a filter between the mixer and the arming switch that filters the mixed signal.

12. The weapon arming system of claim 6, wherein at least one of the logic elements is a digital logic element.

13. The weapon arming system of claim 6, wherein at least one of the logic elements is an analog logic element.

14. A method of arming a weapon, the method comprising:

receiving respective output signals from a pair of logic elements actuated by separate respective arming events, wherein the logic elements selectively send different respective output signals in response to the occurrence of the arming events;

electrically combining the output signals into a mixed signal; and passing the mixed signal to an arming switch that selectively outputs an arming signal based on the mixed signal;

wherein the output signals are signals with different respective frequencies.

15. The method of claim 14, wherein the combining the signals includes using a mixer to combine the signals to produce the mixed signal.

16. The method of claim 15, further comprising evaluating the mixed signals includes for the presence in the mixed signal of a signal portion at a frequency corresponding to a difference between the different respective frequencies.

17. The method of claim 16, further comprising, prior to the evaluating, passing the mixed signal through a band pass filter.

18. The method of claim 17, wherein the band pass filter is tuned to a difference between the different frequencies of the output signals of the logic elements.

19. The method of claim 14, further comprising amplifying the arming signal output by the arming switch, to produce an amplified arming signal.

20. The method of claim 19, further comprising using the amplified arming signal to arm the weapon.

* * * * *